US005904247A

United States Patent [19]

Voelkner, Jr.

[11] Patent Number: 5,904,247

[45] Date of Patent: May 18, 1999

[54] LOCKING GOLF BAG HOOD

[76] Inventor: William D. Voelkner, Jr., 290 Queen Marie, Henderson, Nev. 89015

[21] Appl. No.: 08/841,841

[22] Filed: May 5, 1997

Related U.S. Application Data

[63] Continuation-in-part of application No. 08/539,881, Oct. 6, 1995, abandoned.

[51] Int. Cl.[6] ..... A63B 55/00

[52] U.S. Cl. ..... 206/315.4; 206/315.3; 150/159

[58] Field of Search ..... 150/159; 206/315.3, 206/315.4; 190/101; 70/58

[56] References Cited

U.S. PATENT DOCUMENTS

| | | | |
|---|---|---|---|
| 1,311,040 | 7/1919 | Burton | 70/64 |
| 1,507,510 | 1/1924 | McQuirk | 206/315.4 |
| 1,557,433 | 10/1925 | Delamater et al. | 206/315.4 |
| 1,562,030 | 11/1925 | Lawrence | 206/315.4 |
| 1,570,510 | 1/1926 | McQuirk | 206/315.4 |
| 1,774,454 | 8/1930 | Ritchie | 206/315.4 |
| 1,908,998 | 5/1933 | Mullins | 206/315.4 |
| 1,928,922 | 10/1933 | Adams | 206/315.4 |
| 2,094,186 | 9/1937 | Patrick | 206/315.4 |
| 2,165,665 | 7/1939 | Thompson | 206/315.4 |
| 2,802,501 | 8/1957 | Stember | 150/102 |
| 2,953,010 | 9/1960 | Behnke | 70/65 |
| 3,521,689 | 7/1970 | Woods, Jr. | 150/159 |
| 3,777,862 | 12/1973 | Zipper | 190/903 X |
| 4,738,341 | 4/1988 | Asano | 190/101 |
| 4,953,768 | 9/1990 | Muse | 150/159 X |
| 5,131,442 | 7/1992 | Bevier | 150/159 |
| 5,383,505 | 1/1995 | Cordasco, Jr. | 206/315.4 X |
| 5,443,156 | 8/1995 | Shioda | 206/315.4 |
| 5,490,594 | 2/1996 | Rupe | 206/315.4 |
| 5,507,332 | 4/1996 | McKinnon | 206/315.4 X |
| 5,560,485 | 10/1996 | O'Hara, Jr. | 206/315.4 |
| 5,582,043 | 12/1996 | McCue et al. | 206/315.4 X |

FOREIGN PATENT DOCUMENTS

| | | | |
|---|---|---|---|
| 6126 | 12/1911 | United Kingdom | 206/315.3 |

*Primary Examiner*—Sue A. Weaver
*Attorney, Agent, or Firm*—Quirk & Tratos

[57] ABSTRACT

A hook for securing clubs within a golf bag and for securing the golf bag to another object is disclosed. The hood comprises a pair of zippered hood members connected at their bottom edges by a circular collar. The collar encircles the bag and when folded upwardly upon the bottom of the hood members, forms a pocket for storage of the hood members. A cable having loops at each end extends around the collar passing under a strap or ring on the bag. The hood members are movable from a first position stored within the pocket, to a second, deployed, position in which they cover the open end of the bag when zipped together. The hood is secured over the bag by locking a ring connected to the zipper to the cable.

11 Claims, 3 Drawing Sheets

Fig.1
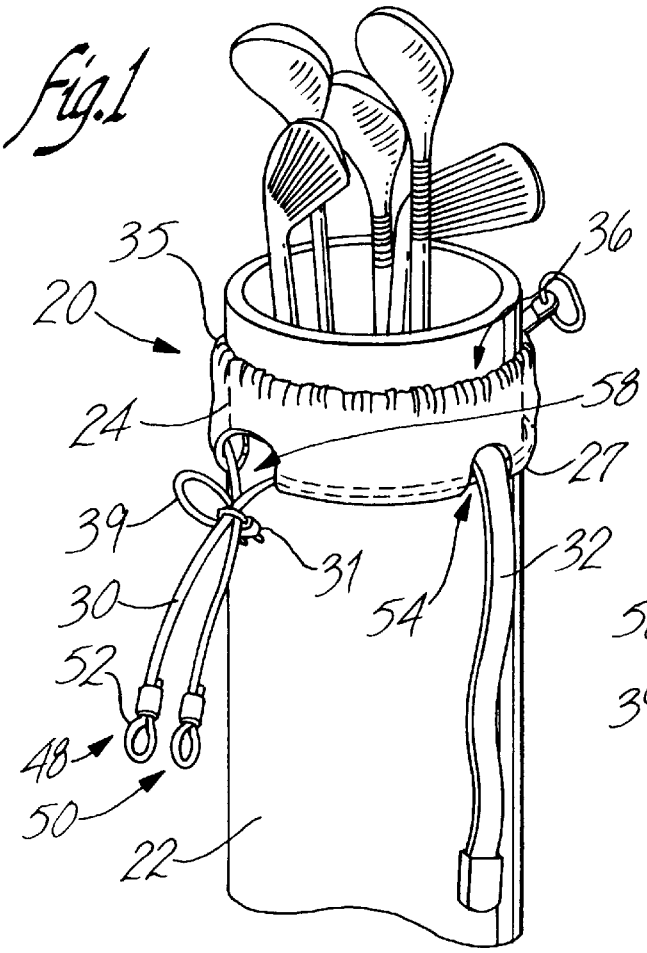
Fig.2
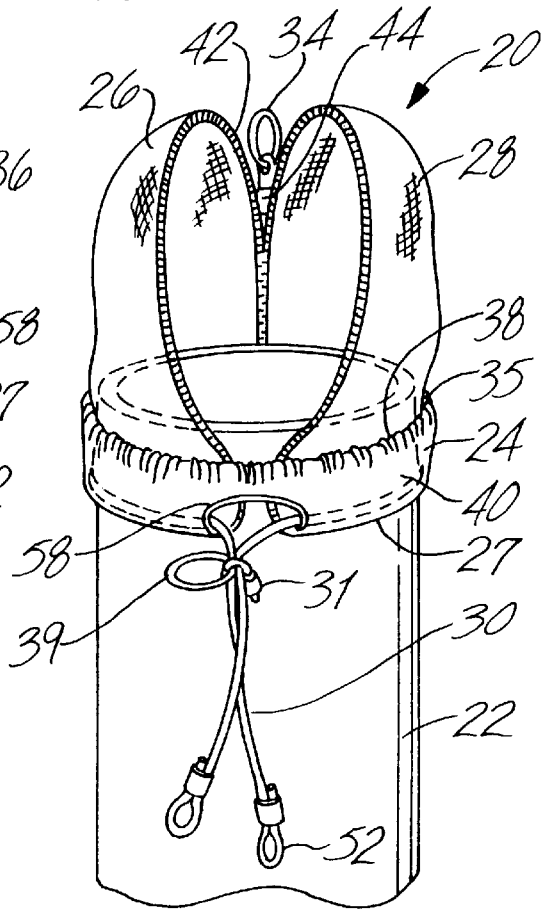
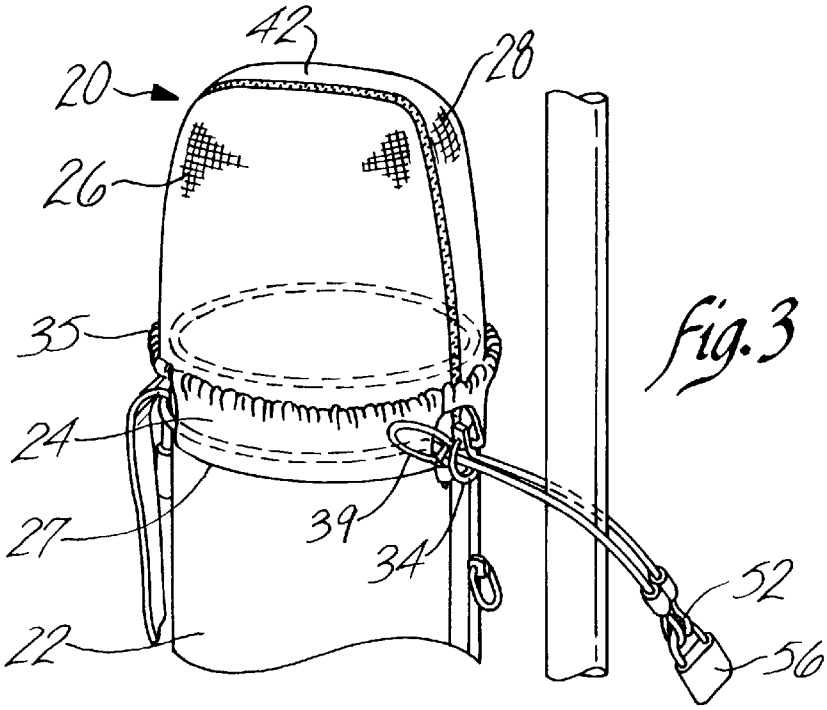
Fig.3

136
120
160
131
134
130
122

126
142
134
144
128
120
136
160
162
130
139
131
122

20
28
26

34
39
56
31
50
48

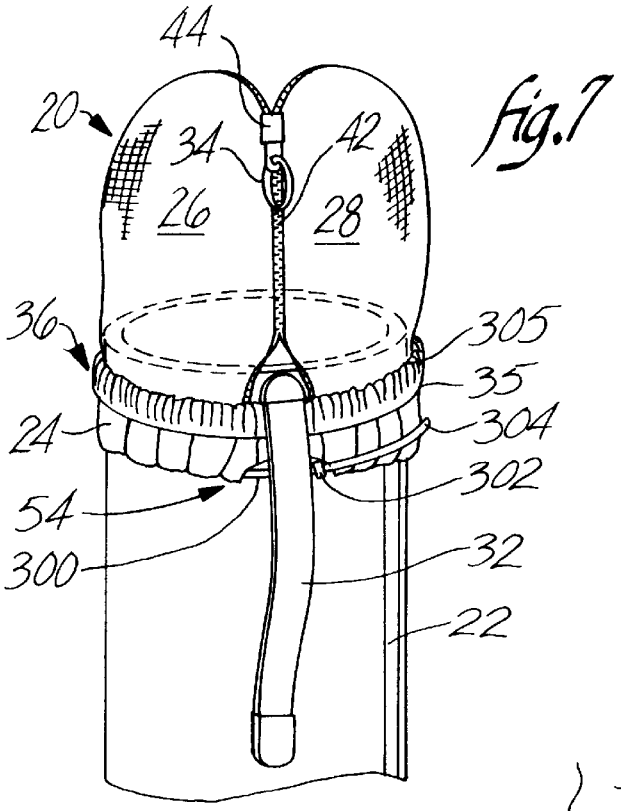
fig.7
fig.9
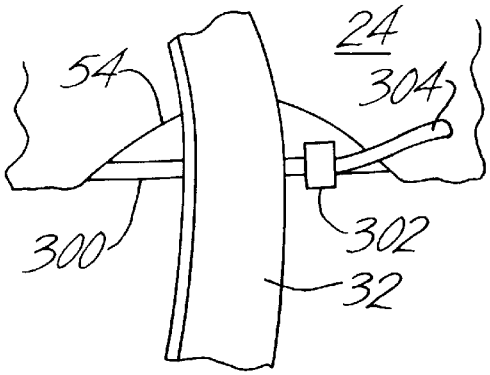
fig.8
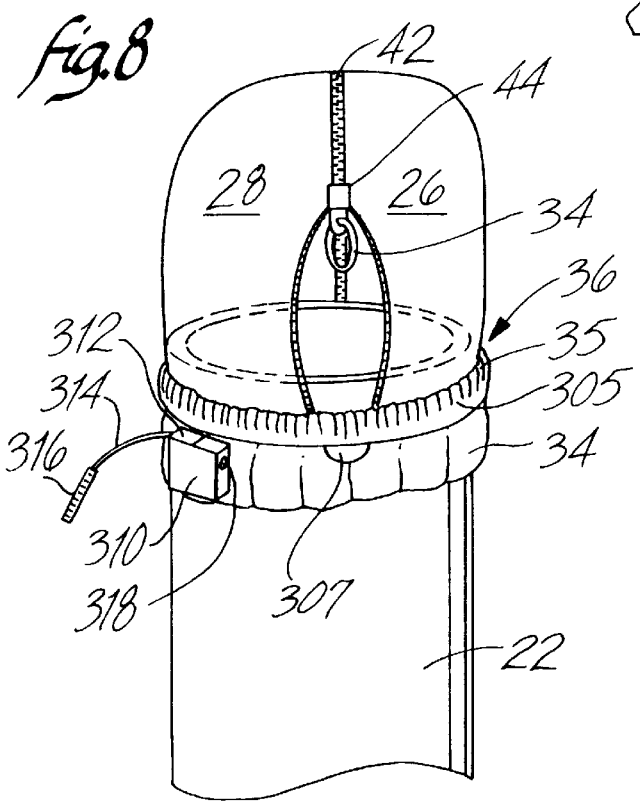

LOCKING GOLF BAG HOOD

CROSS-REFERENCE TO RELATED APPLICATION

This application is a continuation-in-part application of my prior filed application titled "Locking Golf Bag Hood" filed Oct. 6, 1995, Ser. No. 08/539,881, now abandoned.

FIELD OF THE INVENTION

The present invention relates to a hood for use in covering the open end of a golf bag and locking clubs in the bag securely therein, and for locking the entire bag containing clubs to a secure object to prevent their theft.

BACKGROUND OF THE INVENTION

Golf clubs and bags are very expensive items which, especially in recent years, have become the subject of theft. Theft of golf clubs and bags is simple because of the manner in which the owner stores them.

For example, a golfer typically must leave his bag and clubs in a rack outside of the clubhouse, or on his golf cart. The golfer leans the bag containing clubs against the rack, and then proceeds to enter the clubhouse. Often, the golfer can not maintain visual contact with his clubs while in the clubhouse. Alternatively, the bag and clubs are left on the back of a golf cart which is parked somewhere outside of the clubhouse.

When in either of these two locations, a thief may remove one or more clubs from the bag. The thief may also pick up and take the entire bag containing all of the clubs and accessories.

A simple means is needed for locking golf clubs within a bag to prevent their theft. The locking means must be effective in deterring theft of the clubs, but must also not interfere with the use of the bag, including placement and removal of the clubs from the bag during play.

Further, there is also a need for a means for locking an entire bag containing clubs to prevent theft of the bag. A method is needed for locking the bag to items such as golf carts, bag racks, poles and similar items to prevent a thief from stealing the bag and clubs.

SUMMARY OF THE INVENTION

The present invention is a hood for securely enclosing the top open end of a golf bag, and for locking the bag to a secure item.

In a first embodiment, the hood comprises first and second mating hood members connected at a bottom edge by a circular collar. The collar is a circular member sized for positioning around the outside of the golf bag. When installed on the bag, the collar is turned upwardly over the outside of the bottom portion of the hood members, thus forming pocket between the inside surface of the collar and the outside surface of the bag. First and second cutouts or notches are located in the collar.

The hood members are movable from a first stored position in the pocket to a second extended position over the open end of the bag and the clubs therein. A zipper is located on the hood members, allowing them to be securely connected into a solid cover, or disconnected to provide access to the clubs in the bag.

A cable extends around the inside of the collar, and has a loop at a first and second free end. The portions of the cable which meet after encircling the bag are joined by a connector, with the free ends of the cable extend outwardly therefrom away from the bag.

A first ring is located on the zipper slide. A second ring is secured to the connector on the cable. The free ends of the zipper are aligned with one of the cutouts in the collar, which is also where the cable meets itself with the free ends thereof extend outwardly of the bag.

The second cutout in the collar is oriented adjacent a strap or similar secure item on the bag. The cable passes out of the collar, under or through the secure item on the bag, and bag into the collar at the cutout.

In use, a golfer places the collar of the hood over a golf bag. The golfer runs the cable in the collar underneath a strap or other secure portion of the bag. The golfer extends the hood members from the pocket formed by the collar up over the top end of the bag, and any clubs therein. The golfer zips the two hood members together, pulling the ring on the zipper through the cutout adjacent the cable. The golfer then locks the hood in place by padlocking the ring on the zipper to the cable or second ring.

In this position, the hood securely encompasses and encloses the top end of the bag, preventing removal of the clubs. A thief may not remove the hood, because the cable passes underneath the strap, preventing movement of the collar off either end of the bag. Further, the thief can not separate the hood members, as the zipper can not be unzipped because the ring thereon is locked to the cable which encircles the bag.

In a further aspect of the present invention, the cable is long enough that the golfer can extend the ends of the cable around a secure object to prevent theft of the entire bag. After passing one or both of the cable ends through the ring on the zipper, the golfer extends the cable around a pole, golfcart or similar immovable object, and locks the ends of the cable to one another.

In a second embodiment of the present invention, the hood is made a permanent part of a golf bag. In this form of the invention, a pocket is located in the outside of the side wall of the bag. The hood members are connected to the bag inside of the pocket and are movable between a first position in which they are stored in the pocket in the bag and a second position in which they cover the top open end of the bag.

The cable runs around the bag inside of the pocket, with the two ends extending through a cutout to the outside of the bag. A connector having a ring positioned thereon joins the cable where it extends from the bag. Locking of this hood embodiment is similar to that described above.

In yet another embodiment, the collar is secured to the bag using a selflocking tie. The tie extends around the bag and through a secured handle for the bag. Thus the collar may not be removed from the bag without cutting the tie. A lock of the type having a retractable line is disposed in a pocket on the collar. To lock the bag, the lock line is threaded around a structure such as a club rack and locked into the lock. Thus the bag may not be removed. Similar to the embodiments described above, the hood may be stowed rolling it down into the collar. When the hood is deployed over the clubs, the hood is zipped closed and the lock line extended through the zipper ring to prevent opening of the hood.

Further objects, features, and advantages of the present invention over the prior art will become apparent from the detailed description of the drawings which follows, when considered with the attached figures.

DESCRIPTION OF THE DRAWINGS

FIG. 1 is a perspective view of a golf bag with a hood of the present invention mounted thereon in a stored position;

FIG. 2 is a perspective view of the bag and hood of FIG. 1 with the hood in an extended position;

FIG. 3 is a perspective view of the bag and hood of FIG. 1 with the hood in a closed, locked position over the open end of the bag with the bag locked to a post;

FIG. 7 is a view of yet a further embodiment of the bag and hood showing the hood partially deployed;

FIG. 8 is a view of the other side of the bag of FIG. 7 showing the lock and the hood near closure; and FIG. 9 is an enlarged view of the collar for the hood of FIG. 7 showing the connection of the hood to the bag according to this embodiment.

DETAILED DESCRIPTION OF THE PREFERRED EMBODIMENT

Figure 5:
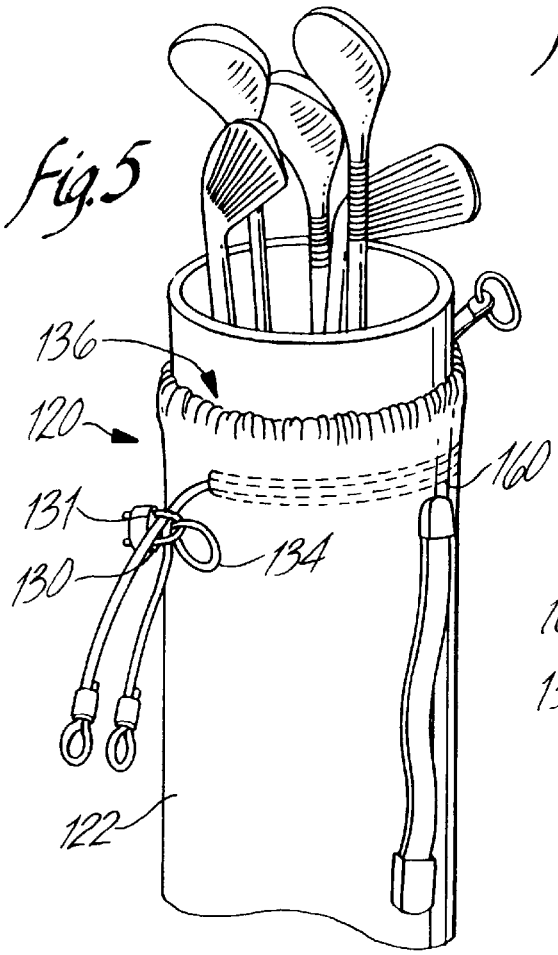
FIG. 5 is a perspective view of a second embodiment hood of the present invention in a store position.

FIGS. 1–4 illustrate a first embodiment locking golf hood 20 in accordance with the present invention for use with a golf bag 22. In general, the hood 20 comprises two mating zippered hood halves 26,28 connected at their bottom edges by a contiguous circular collar 24. The collar 24 encircles the bag 22 and is folded upwardly upon the hood halves 26,28, thus forming a pocket 36 between the inside surface of the collar and the outside surface of the bag in which the hood halves 26,28 may be stored.

A cable 30 having two free ends 48,50 comprising loops extends around the inside of the collar 24. The cable 30 passes under the strap 32 of the golf bag 22. While the hood according to the present invention is adapted to be attached to any bag by passing the cable 30 under the strap 32, it is to be understood that any other existing or provided fixture on the bag to pass the cable 30 could be used. Hence strap as used herein is meant to embrace not only the carrying strap for the bag but any other loop, fixture, eyelet or the like which is secured to the bag and can accommodate the cable 30. A connector 31 joins portions of the cable 30 near where the cable meets itself after encircling the bag, with the free ends 48,50 extending outwardly therefrom. A first ring 34 is connected to the zipper slide and a second ring 39 is secured to the connector 31 for use with a padlock in locking the zipper in a closed position.

In use, a golfer places the hood 20 around the top end of a golf bag 22, with the cable 30 routed between the strap 32 and the bag. The golfer pulls the unzipped hood halves 26,28 upwardly out of the pocket 36 formed between the collar 24 and bag 22. The golfer extends the hood halves 26,28 over the clubs in the bag 22 and zips them together by pulling the zipper slide.

Figure 4:
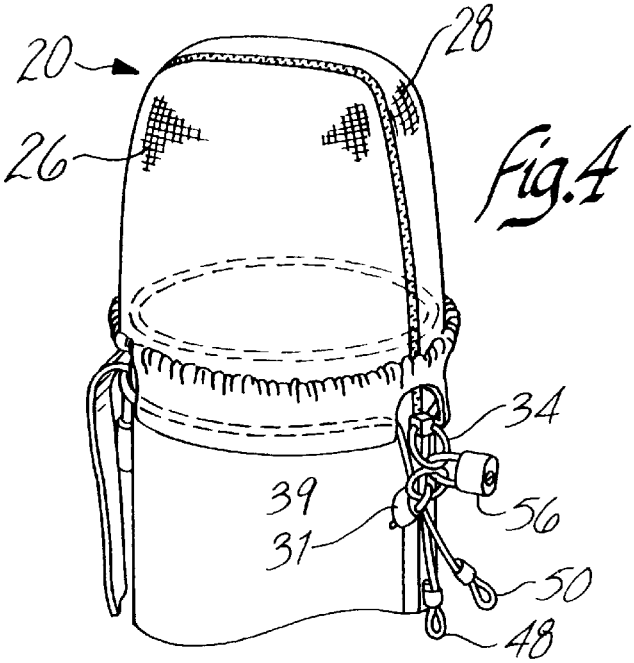
FIG. 4 is a perspective view of the bag and hood of FIG. 1 with the hood in a closed and locked position over the open end of the bag.

As illustrated in FIG. 4, the golfer locks the hood 20 securely over the top of the bag 22 by locking a padlock to the ring 39 on the connector 31 and the ring 34 on the zipper.

When so installed, the hood 20 immovably surrounds the top of the golf bag 22, preventing removal of the clubs. The hood halves 26,28 can not be unzipped because upward movement of the zipper is prevented because the ring thereon is attached to the cable 30 which encircles the bag 22. The entire hood 20 can not be removed from the bag 22 because the cable 30 passes under the bag strap 32.

Advantageously, the golfer can lock the entire bag 22 to a secure object such as a pole, rack, or golf cart, as illustrated in FIG. 3. A golfer simply passes one or both of the free ends 48,50 of the cable 30 through the zipper ring 34 and around the secure item. The golfer then padlocks the free ends of the cable 30 together.

Figure 6:
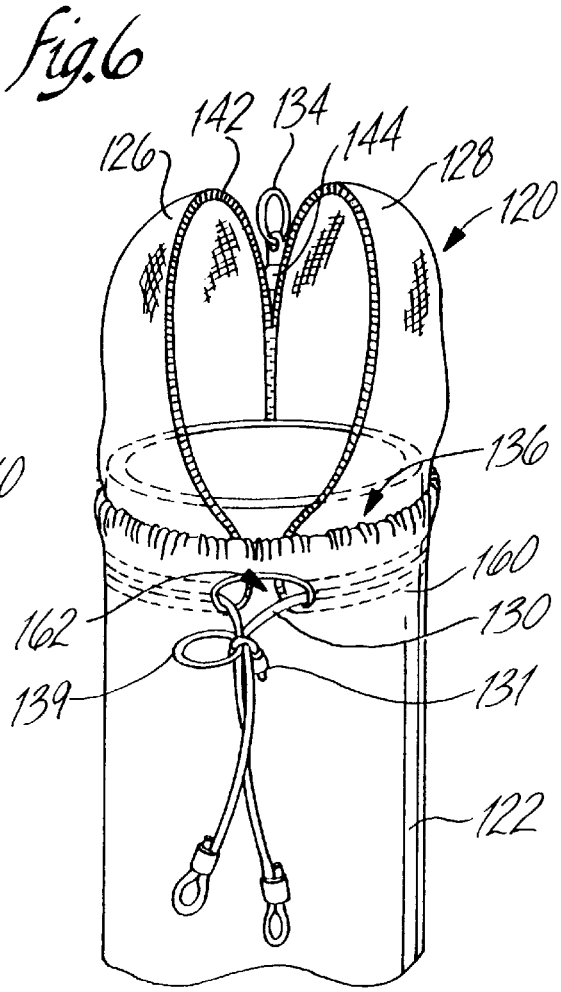
FIG. 6 is a perspective view of the hood of FIG. 5 illustrated in an extended position.

FIGS. 5—6 illustrate a second embodiment locking golf hood 120 in accordance with the present invention. In this embodiment, zippered hood halves 126,128 are connected to the bag 122 inside of a pocket 136 located in the bag near its top open end. A cable 130 passes around the bag 122 inside of the pocket 136, with its free ends 148,150 extending outside of the bag.

Use of this hood 120 is similar to the hood 20 described above, except that the hood 120 is constructed as part of the bag 122 and can not be removed therefrom.

Referring again to FIG. 1, the hood 20 comprises mating hood halves 26,28 connected to a circular collar 24. Each hood halve 26,28 comprises a section of cloth or similar durable material configured so that when the halves are joined they form an a solid cover extending from the collar 24 for enclosing the open end of the bag with a set of golf clubs therein.

The collar 24 is a contiguous circular member located at the bottom edges of the hood halves 26,28. Preferably, the collar 24 and hood halves 26,28 comprise a single piece of material, although the hood halves 26,28 and collar 24 may be separate elements which are sewn or otherwise attached to one another.

The collar 24 is sized to fit around the exterior of a golf bag 22. For durability, the collar 24 and hood halves 26,28 are preferably constructed of a durable cloth material, such as Cordura™.

When the hood 20 is installed on the bag 22, the collar 24 is folded upwardly over the bottom portions of the hood halves 26, 28. In this position, the collar 24 has an inner surface 38 which faces the bag and an outer surface 40 facing outwardly of the bag. Further, the collar 24 has a top edge 35 and a bottom edge 37.

When the collar 24 is folded upwardly over the hood halves 26,28, it forms a pocket 36 between itself and the bag 22. The collar 24 is preferably sized so that the pocket 36 created is large enough to house the hood halves 126,128 therein.

Preferably, elastic or similar material is positioned at the top edge 35 of the collar 24 so that the collar firmly hugs the outside of the bag 22. This tight fit of the top edge 35 of the collar 24 to the bag 22 ensures that the hood halves 26,28 are securely stored in the pocket 36.

Means for selectively connecting the hood halves 26,28 comprises a zipper 42 mounted on said hood halves 26,28. Preferably, half of said zipper 42 is connected to one of the hood halves 26, and the mating portion of said zipper 42 is connected to the other of the hood halves 28. A zipper slide 44 is connected to each portion of the zipper 42 for locking and unlocking the teeth of the zipper, as is well known in the art.

Preferably, a first ring 34 is connected to the zipper slide 44. The first ring 34 is preferably a metal loop of material connected to the tab 44 and having a size through which the ends of the cable 30 or the loop of a padlock may pass, as described in more detail below.

The cable 30 is preferably attached to the hood 20, encircling it in an enclosed passage in the collar. The cable 30 has a first end 48 and second end 50. A loop or eye 52 is located at both the first and second ends 48,50 of the cable 30. The loop 52 may comprise a segment of the cable 30 turned back upon itself, or a separate ring which is securely attached to the cable. The loop 52 has a diameter large enough that a user may pass the pin of a standard padlock 56 therethrough.

Preferably, the cable 30 comprises a durable material such as steel. When made of steel, the cable 30 may be coated with plastic or rubber to reduce wear of the hood 20 by the cable.

A connector 31 joins portions of the cable 30 where the cable meets itself after encircling the bag 22. The connector 31 is preferably a U-clamp or similar fastening mechanism for securing the cable together, such that the cable fairly tightly encircles the bag 22, and has free ends 48,50 extending therefrom. Preferably, a second ring 39 is secured to the connector 31. This ring 39 is preferably similar to the first ring 34.

The cable 30 is long enough to encircle the hood 20, and thus the bag 22 on which the hood is mounted. As described below, the free ends 48,50 of the cable 30 extend outwardly of the bag 22 a sufficient distance that a user can pass the ends around an adjacent fixed object, such as a light pole, post, golf cart, or similar object.

The cable 30 is oriented with respect to the hood 20 so that the first and second ends 46,48 extend outwardly from the hood aligned with the separatable portion of the zipper 42, as illustrated in FIG. 2. In particular, a cutout 58 is located in the collar 24 at the point where the ends of the cable 30 exit and the zipper 42 ends are located.

The presence of the cutout 58 allows a user to pull the zipper ring 34 downwardly out the bottom edge 37 of the collar 24 adjacent the cable 30.

Preferably, a notch 54 is located in a bottom edge 37 of the collar 24 of the hood 20 opposite the cutout 58. The notch 54 accommodates a section of the bag 22 so that the cable 30 which runs through the collar 24 may be secured thereto. More specifically, the notch 54 is preferably sized to allow the cable 30 to extend across the opening in the collar formed thereby and pass under a bag strap 32 or similar portion of the bag 22.

Use of the first embodiment hood 20 of the present invention is as follows. A golfer preferably locates the hood 20 on a golf bag 22. The golfer pulls the hood 20 over the top end of the golf bag 22 until the hood is located below the top rim of the bag.

The golfer aligns the notch 54 in the hood 20 with a loop, strap or similar secure item on the bag 22. The golfer then routes the cable 30 underneath or through the secure portion of the bag. Preferably, as illustrated in FIG. 1, the golfer routes the cable 30 underneath the attached strap on the bag 22. The notch 54 in the collar 22 accommodates placement of the cable 30 underneath the strap. At this time, the collar 24 is in the position illustrated in FIG. 1. In this position, the hood 20 does not interfere with the golfer's access to the clubs or other portions of the bag.

To secure the clubs in the bag, the golfer pulls the unconnected hood halves 26,28 from the pocket 36 of the collar 24. The golfer extends the hood halves 26,28 over the clubs, as illustrated in FIG. 2.

The golfer zips closed the zipper 42, mating the two hood halves 26,28 together, enclosing the clubs in the bag 22 under the hood 20. The golfer pulls the zipper ring 24 down until it is located adjacent the cable 30.

If the golfer simply desires to prevent access to the clubs inside the bag 22, the golfer can simply pass the pin of a padlock 56 of similar locking device through the first ring 34 on the zipper and the second ring 39 on the connector 31. At this time the hood 20 is in the position illustrated in FIG. 4.

Once locked, another person may not remove the hood 20 from the bag 22, thus preventing access to the clubs stored therein. In particular, the hood 20 may not be removed from the bag 22 because the cable 30 passes under a secure portion of the bag. Thus, a person's attempts to lift up the hood 20 over the clubs is fruitless.

Further, another person can not unzip the zipper 42 to gain access to the clubs. Movement of the zipper 42 is prevented because the zipper slide 44 is connected to the cable 30.

If a golfer wishes to prevent theft of the entire bag 22 as well as prevent access to the clubs therein, the golfer locks the bag 22 to a secure or otherwise immovable object such as a post, pole, rack, or golf cart. As illustrated in FIG. 3, a golfer passes one or both of the ends 48,50 of the cable 30 through the ring 34 on the zipper slide 44. The golfer pulls the ends 48,50 of the cable 30 around a pole and then padlocks them together.

It is noted that in this form of the invention, there are many other manners by which the hood 20 may be locked in placed. For example, instead of the arrangement described above, the golfer may pass one or both ends 48,50 of the cable 30 through the first ring 34, and then padlock the cable end to the second ring 39 on the connector 31.

Alternatively, the golfer may lock the first ring 34 to the cable 30 at a point on the cable before the connector 31. The golfer may also pass one of the ends 48 of the cable through the first ring 34 and then padlock the ends 48,50 of the cable together.

FIGS. 5 and 6 illustrate a second embodiment of the present invention. In this form of the invention, the hood 120 comprises a pocket 136 located in the outer surface of the sidewall of the bag, with a first hood halve 126 and second hood halve 128 connected to the bag 122 inside of the pocket.

The hood halves 126,128 are similar to those described above. Means for securing the hood halves 126,128 together preferably again comprises a zipper 142. A first ring 134 is connected to the zipper tab 144.

A cable 130 runs around the bag 122, preferably within a channel 160 formed within the pocket 136. The channel 160 may be formed by stitching closed a bottom portion of the pocket 136. The cable 130 exits the pocket 136 through a cutout 162. A connector 131 having a second ring 139 thereon joins the cable 30 near where it meets itself after exiting the cutout 162 in the bag 122.

In this form of the invention, the hood halves 126,128 are easily stored in the pocket 136 in the bag 122, as illustrated in FIG. 5. In this position, the hood 120 in no way interferes with the golfer's use of the bag, including access to the clubs.

The golfer reaches into the pocket 136 and pulls out the hood halves 126,128 to lock the bag 122. As illustrated in FIG. 6, the golfer extends the hood halves 126,128 until they cover the open end of the bag 122, and then zips them together to enclose the open end of the bag. The golfer then locks the hood 120 closed in a fashion similar to that described above. If the golfer simply wishes to lock the bag closed 122, the golfer may lock the hood in a fashion similar to that illustrated in FIG. 4. If the golfer wishes to lock the bag to a secure item such as a pole, the golfer locks the hood 120 in a fashion similar to that illustrated in FIG. 3.

Advantageously, in the second form of the invention, the hood 120 is formed as a unitary part of the bag 122. In this manner, the golfer need not be concerned with removing the hood and then forgetting it. Further, the hood 120 is very secure. In particular, it is not possible to remove the hood 120 because is formed as part of the bag 122. Moreover, the cable 130 runs within the bag 122 itself, thus making it very difficult to remove by a criminal.

In the second form of the invention, the cable 130 need not encircle the bag 122. In particular, two "stems" or short cables may be anchored to the bag and extend therefrom. Also, it is possible to eliminate the cable 130 altogether in the second form of the invention by securing a ring directly to the bag 122 near where the zipper zips closed. This form of the invention is not preferred, however, because it does not readily permit a golfer to lock the bag 122 to another secure item.

In either form of the invention, it is possible for the cable 30,130 to comprise a contiguous ring which encircles the bag 22,122. In this form, the zipper 141 is readily locked by padlocking the ring 134 thereon to the cable 130.

In either form of the invention there need not be a second ring 39,139. This is true because of the other arrangements by which the ring 34,134 on the zipper 42,142 may be locked to the cable 30,130 to prevent unzipping.

With reference to FIGS. 7–9 a further embodiment of the present invention is shown. Like parts carry like reference numbers.

According to this embodiment, a self-locking tie 300 is provided around the collar 24 as by being included in a lower hem thereof. The cable is defined as a tie 300 of the type fashioned from a durable plastic having on one side a plurality of teeth (not shown). The tie 300 is of the type used in packaging and for hand restraints by law enforcement personnel. At one end the tie 300 has a self-locking clasp 302 which also passes the free end 304 therethrough. Accordingly, to secure the collar 24 to the bag 22, the user positions the collar 24 such that the notch 54 is aligned with a permanently affixed handle 32 for the bag 22. The tie 300 is passed through the handle as shown in FIGS. 7 and 9, or any other permanently secured loop on the bag 22, and the free end is passed through the clasp 302. The free end 304 is pulled to tighten the tie 300 to the bag 22. Once tightened, the clasp 302 and toothed side of the tie 300 cooperate to affix the tie 300 and collar 24 to the bag 22. Once secured, the tie 300 and permanently secured bag handle 32 cooperate such that the only way to remove the tie 300 and collar 24 is to cut the tie 300. Any excess length of the free end 304 for the tie 300 is trimmed. At its upper margin, the collar 24 has an elastic hem 305 which is adapted to close around the bag 22.

The collar 24 defines the pocket 36 which stows the hood halves 26,28 in the manner described above.

With reference to FIG. 8, disposed on the collar is a pouch 310 which houses a cable lock 312 or the type having a case (not shown) mounting tumblers and a self retracting line 314 having at the end thereof a locking bolt 316. Locks of this type are known in the art. The user selects a combination for the lock. The line 314 is retractably extensible from the case. At one side, the pouch 310 includes a hole 318 to provide access for the bolt 316 to be inserted and locked into the lock.

To secure the clubs within the bag 22, the hood halves 26, 28 are deployed and zipped closed as suggested in FIG. 8. The ring 34 for the zipper 42 is passed under the elastic hem 305 and through an opening 307 in the collar 34, Once closed, the lock line 314 is extended from the cable lock 312, threaded through the zipper ring 34 and the bolt 316 is inserted through the hole to lock into the cable lock 312. Excess line is retracted into the cable lock 312. The cable lock 312 thus locks the zipper 42 closed. When locked the line 314 cannot be extended from the cable lock 312. Further the zipper 42 cannot be operated by the cooperation of the ring 34, hem 305 and lock. To lock the bag 22, the line 314 need only be also threaded around a bag rack or pole.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A golf bag and hood combination, said bag having an open end for placement and removal of golf clubs and a strap secured to the bag, the combination comprising:

hood members each having bottom edges and adapted to be connected together to define a hood for the open end of the bag and any clubs located therein;

a collar disposed about the outside of the golf bag proximate the open end, said hood members connected at their bottom edges to the collar, said collar folded over upon itself to define an upwardly open pocket adapted to receive and stow the hood members, said hood members adapted to be deployed from the pocket;

a cable retained by the collar and adapted to be passed between the strap and the bag to secure the collar onto the bag and prevent removal of the collar without severing the cable with the hood members stowed or deployed;

a slideable fastener adapted to connect the hood members together, said fastener including a ring; and means for locking the ring to the collar when the hood members are connected together to prevent unauthorized access to the bag open end.

2. The golf bag and hood combination of claim 1 wherein the cable is a tie including a self-locking clasp.

3. The golf bag and hood combination of claim 1 wherein the locking means includes a lock secured to the collar, the lock of the type having a retractable line and bolt adapted to be passed through the ring and locked to the lock.

4. The golf bag and hood of claim 3 wherein said collar includes a pouch to mount the lock.

5. The golf bag and hood combination of claim 1 wherein the collar includes an elastic hem adapted to constrict the pocket to a closed condition.

6. The golf bag and hood combination of claim 5 wherein the pocket includes an open notch disposed proximate the elastic hem, said notch adapted to pass said ring through the pocket.

7. The golf bag and hood combination of claim 1 wherein the locking means includes a retractable cable adapted to be passed through said ring and a lock adapted to secure the cable length against removal from the ring.

8. A hood adapted to be attached to a golf bag of the type having an open top and a carrying strap secured to the bag, the hood comprising:

a collar adapted to be attached to the golf bag proximate the open end thereof, said collar including a cable adapted to go around the bag and between the strap and bag, said collar folded over upon itself to define an upwardly open pocket, said collar including an elastic hem adapted to bias the pocket to a closed condition;

means for locking the cable around the bag, the cable and strap cooperating such that the collar is locked to the bag against unauthorized removal thereof;

a pair of hood members attached to the collar and deployable from a stowed position whereat the members are stowed in a rolled condition substantially within the collar pocket and a deployed condition whereat the members are unfurled from the pocket to cover the open end of the bag, said hem adapted to expand to provide for unfurling of the hood members;

a zipper to connect the hood members together in the deployed condition, said zipper having a slide with a ring; and means for locking the zipper ring to the collar to prevent unauthorized access to access the open end of the bag.

9. The hood of claim 8 wherein the cable is a self locking tie.

10. The hood of claim 8 wherein the locking means includes a lock secured to the collar, the lock of the type having a retractable line and bolt adapted to be passed through the ring and locked to the lock.

11. The hood of claim 10 wherein said line is of a length to pass around a structure adjacent the bag to lock the bag thereto.

* * * * *